US008696937B2

(12) United States Patent
Gharda

(10) Patent No.: US 8,696,937 B2
(45) Date of Patent: Apr. 15, 2014

(54) PROCESS FOR OBTAINING PETROCHEMICAL PRODUCTS FROM CARBONACEOUS FEEDSTOCK

(76) Inventor: Keki Hormusji Gharda, Bandra (West) Mumbai (IN)

( * ) Notice: Subject to any disclaimer, the term of this patent is extended or adjusted under 35 U.S.C. 154(b) by 0 days.

(21) Appl. No.: 13/882,999

(22) PCT Filed: Oct. 24, 2011

(86) PCT No.: PCT/IN2011/000733

§ 371 (c)(1),
(2), (4) Date: May 2, 2013

(87) PCT Pub. No.: WO2012/059938

PCT Pub. Date: May 10, 2012

(65) Prior Publication Data

US 2013/0214207 A1 Aug. 22, 2013

(30) Foreign Application Priority Data

Nov. 2, 2010 (IN) ..... 3041/MUM/2010

(51) Int. Cl.
*C10B 49/02* (2006.01)

(52) U.S. Cl.
USPC ..... 252/373; 585/240; 585/319; 585/321; 585/324; 585/310; 201/4; 201/8

(58) Field of Classification Search
None
See application file for complete search history.

(56) References Cited

U.S. PATENT DOCUMENTS

| | | | | | |
|---|---|---|---|---|---|
| 3,034,979 | A | | 5/1962 | Nevens | |
| 3,855,070 | A | * | 12/1974 | Squires | 201/23 |
| 4,210,492 | A | | 7/1980 | Roberts | |
| 4,559,130 | A | * | 12/1985 | Reynolds et al. | 208/59 |
| 4,578,175 | A | * | 3/1986 | Gorin | 252/373 |
| 4,699,632 | A | * | 10/1987 | Babu et al. | 48/197 R |
| 4,865,625 | A | * | 9/1989 | Mudge et al. | 48/197 R |

FOREIGN PATENT DOCUMENTS

| | | | | |
|---|---|---|---|---|
| CA | 1117049 | | 1/1982 | |
| CN | 2010/10132481 | * | 3/2010 | C10J 3/66 |
| CN | EP 2551331 | * | 1/2013 | C10J 3/66 |
| WO | 2007/121268 | | 10/2007 | |
| WO | 2010/080525 | | 7/2010 | |
| WO | WO 2011/092292 | * | 8/2011 | B01J 21/02 |
| WO | WO 2011/116689 | * | 9/2011 | C10J 3/66 |

* cited by examiner

*Primary Examiner* — Melvin C Mayes
*Assistant Examiner* — Douglas Call
(74) *Attorney, Agent, or Firm* — Whiteford, Taylor & Preston, LLP; Joseph L. Morales

(57) ABSTRACT

A process for obtaining petrochemical products from a carbonaceous feedstock is provided. The carbonaceous feedstock may be coal, coke, lignite, biomass, bitumen and the like. The carbonaceous feedstock is pulverized and fed to a pyrolysis reactor where the feedstock is pyrolyzed at 700-1000° C. at a pressure of 2-25 bar for 2-10 seconds, wherein the feedstock is entrained in hot syngas during the pyrolysis process.

8 Claims, No Drawings

PROCESS FOR OBTAINING PETROCHEMICAL PRODUCTS FROM CARBONACEOUS FEEDSTOCK

CROSS-REFERENCE TO RELATED APPLICATION

This application is a National Stage Entry under 35 U.S.C. §371 of PCT/IN2011/000733, filed Oct. 24, 2011, and claims priority from Indian Patent Application No. 3041/MUM/2010, filed Nov. 2, 2010, which are both incorporated herein by reference in their entirety.

BACKGROUND

1. Field of Invention

The present disclosure relates to a process for obtaining valuable products from carbonaceous feedstock.

2. Discussion of Related Art

Due to the dwindling petroleum resources, in recent years there has been an increased demand for recovery of hydrocarbonaceous compounds from non-volatile carbonaceous matter such as coal, biomass, lignite, municipal solid waste and other carbon-containing wastes, as an alternative method for obtaining petrochemical compounds. A pyrolysis or heat treatment is commonly used by which the carbonaceous matter is decomposed into the hydrocarbon products. When coal is pyrolyzed at a high temperature it undergoes destructive pyrolysis and is converted to liquid and light gaseous hydrocarbonaceous fluids and char. A major problem associated with this process is the low efficiency. Further, it is difficult to manipulate the contact time/residence time in the pyrolysis zone, which is an important factor for deciding the efficiency of the process. Still further, the pyrolysis process requires very short reaction time; therefore, it is very necessary to provide uniform heat distribution through the carbonaceous feed during the reaction time to get optimum yield.

Several attempts have been made in the past to provide processes for obtaining hydrocarbon products from carbonaceous feedstock. Some of the disclosures are listed in the prior art below:

U.S. Pat. No. 3,855,070 discloses a process for hydropyrolyzing a solid or liquid hydrocarbonaceous fuel comprising charging the fuel to a fluidized bed having a bed of coke pellets fluidized with a gas containing hydrogen and operating at a temperature of 1100-1800° F. and pressure greater than 20 atm; wherein the solid products of the hydropyrolysis accrete upon the coke pellets and the gaseous products are collected in a space above the fluidized bed. The process aims at providing an improved method for supplying heat to (or removing heat from) a fluidized bed zone in which coal or oil is pyrolyzed.

U.S. Pat. No. 4,210,492 discloses a process for pyrolysis of coal, characterized by efficient water removal and heat transfer, wherein subdivided coal is preheated, pyrolyzed, and subjected to heat recovery after pyrolysis; the heat transfer being effected by contacting the subdivided coal as a dilute-phase fluidized bed in a first stage of dual preheating zones with a first particulate heat carrier, with a second particulate heat carrier in a dense fluidized bed in a second preheating stage, followed by pyrolysis in a dense fluidized bed pyrolysis zone.

The processes for pyrolyzing carbonaceous feed disclosed in the prior art above are complex, have multiple stages, are operated under very high pressures, and do not overcome all the above-listed drawbacks of the pyrolysis process. Therefore, there is felt a need for an improved process for pyrolyzing carbonaceous material which is simple, single-stage and overcomes the drawbacks of the known processes.

SUMMARY OF THE INVENTION

An object of the present invention is to provide a highly efficient pyrolysis process for obtaining petrochemical products from carbonaceous feedstock.

Another object of the present invention is to provide a pyrolysis process for obtaining petrochemical products from carbonaceous feedstock which is simple and easy-to-operate.

Yet another object of the present invention is to provide a pyrolysis process for obtaining petrochemical products from carbonaceous feedstock which gives uniform heat distribution in the carbonaceous feed during pyrolysis.

Still another object of the present invention is to provide a pyrolysis process for obtaining petrochemical products from carbonaceous feedstock which is single-stage and does not require very high operating pressures.

One more object of the present invention is to provide a pyrolysis process for obtaining petrochemical products from carbonaceous feedstock in which the pyrolysate can be conveniently processed to obtain numerous valuable products.

In accordance with the present invention, is disclosed a process for obtaining petrochemical products from a carbonaceous feedstock, said process comprising the steps of:

- pulverising a carbonaceous feedstock to obtain a pulverized feedstock having mesh size between 50-300, preferably 100-200; and
- pyrolyzing the pulverized feedstock with syngas in a pyrolysis reactor at a temperature in the range of 700-1000° C. and a pressure in the range of 2-25 bar for 2-10 seconds to obtain pyrolysate comprising char, fluid petrochemical product, and at least a portion of the syngas.

Typically, in accordance with the present invention, the process includes the step of selecting the carbonaceous feedstock from at least one material consisting of coal, lignite, biomass, coke, bitumen, organic waste, and the like.

Preferably, in accordance with the present invention, the process includes the step of treating the pyrolsate to separate char, fluid petrochemical product, and syngas.

Typically, in accordance with the present invention, the process includes the step of cracking the fluid petrochemical product to obtain at least one hydrocarbon from ethylene, propylene, benzene, toluene, xylene, methane, and ethane.

Preferably, in accordance with the present invention, the process includes the step of entraining the pulverized feedstock in the syngas during pyrolyzing.

Typically, in accordance with the present invention, the process includes the step of gasifying the char with oxygen and steam at a temperature between 1200-1700° C. and pressure higher than the pyrolyzing pressure to obtain syngas having hydrogen content between 20-30 mole %.

Preferably, in accordance with the present invention, the pyrolysis reactor is a brick-lined vertical reactor.

Alternatively, in accordance with the present invention, the process includes the step of using a cracking catalyst obtained by mixing dry coal powder with at least one compound from fine red mud and alumina containing molybdenum oxide.

DETAILED DESCRIPTION OF THE INVENTION

The present invention envisages a process for obtaining valuable products, particularly petrochemical products, from a carbonaceous feedstock such as coal, coke, lignite, bitumen, biomass, organic waste and other carbon-containing wastes. The process of the present invention comprises the step of pulverizing the carbonaceous feedstock to a mesh size between 50-300, preferably 100-200, and then controllably pyrolyzing the pulverized feedstock in a pyrolysis reactor at a temperature between 700-1000° C., preferably about 800° C., and pressure between 2-25 bar for 2-10 seconds, preferably for 2-5 seconds; wherein hot syngas is received in the pyrolysis reactor through the operative bottom of the reactor so as to entrain the pulverized carbonaceous feedstock during the pyrolysis process. The pyrolysate so obtained in the pyrolysis reactor comprises char, fluid petrochemical product, and at least a portion of syngas.

The pulverized feedstock may be dried to remove moisture prior to the pyrolysis process. In the process of the present invention, the pulverized carbonaceous feedstock must be entrained in the syngas during the reaction time in the pyrolysis reactor. Depending upon the type of carbonaceous material used, the pressure in the pyrolysis reactor may be manipulated for maintaining the feedstock in an entrained state. The pyrolysis reactor is typically a brick-lined vertical reactor so as to permit the short residence time and uniform heat distribution during pyrolysis. Preferably, an entrained bed reactor is used for the pyrolysis process. Alternatively, a fluidized bed reactor, a bubbling bed reactor or a solid-gas contactor can be used for the carrying out the pyrolyzing process of present invention.

The syngas used during the pyrolysis process is generated by gasifying char with oxygen and steam at a temperature between 1200-1700° C. and at a pressure higher than that in the pyrolysis reactor. The gasification can be done in a lowermost region of the pyrolysis reactor or in a separate gasifier from where the syngas is conveyed to the pyrolysis reactor, such that the hot syngas flows upward in the pyrolysis reactor. The hot syngas used in the pyrolysis process mainly comprises carbon monoxide, carbon dioxide and hydrogen, wherein the hydrogen content is preferably between 20-30 mole %.

The pyrolysate is discharged from the pyrolysis reactor from the operative top. The char is separated while hot and the petrochemical product is then quenched. The char so obtained is used in the gasification process with oxygen and steam to generate the syngas. The char can also be used as a fuel, as a carbonaceous material or in any other chemical process. The syngas in the pyrolysate is separated and cleaned under pressure and can be further used for chemical synthesis. The fluid petrochemical product is controllably cracked to obtain numerous products including ethylene, propylene, benzene, toluene, xylene, methane, and ethane. Optionally, a cracking catalyst obtained by mixing dry coal powder with at least one compound from fine red mud and alumina containing molybdenum oxide is used during the cracking process in addition to char.

Test Results

The invention will now be described with respect to the following examples which do not limit the scope and ambit of the invention in anyway and only exemplify the invention.

Example 1

A bituminous-grade low rank coal of Indonesian origin was used; properties of the coal are listed in TABLE 1 below. The coal sample was crushed and dried in a drier to obtain dried coal having a final moisture content of 1.2%. The dried coal was pulverized in an impact pulverizer and in-situ sieved to below 100 microns. The pulverized coal powder was taken in feed hopper and heated externally to 150° C. The feed hopper was connected to the pyrolyzer by means of a screw conveyor. The pyrolyzer was a high temperature high pressure steel tube reactor of 40 mm internal diameter and 10 m height. The pyrolyzer was connected to a gasifier at the operative bottom.

TABLE 1

| | Moisture (%) | Volatile (%) | Ash (%) | Fixed Carbon (%) |
|---|---|---|---|---|
| Bituminous grade low rank coal | 15 | 37 | 8 | 40 |
| Char from Pyrolysis | <0.1 | 1.5 | 15 | 83.4 |

Hot syngas was generated in the gasifier at 1300° C. by reacting char (3 kg/hr), oxygen (3 kg/hr) and super heated steam (3 kg/hr). The syngas composition was analyzed in an on-line Gas Chromatograph. The syngas mainly contained $H_2$ and CO with some minor proportions of $CO_2$, $CH_4$ and water vapor. The pulverized coal powder was fed to pyrolyzer through the screw conveyor at 30 kg/hr rate and flash heated with the syngas which entrained the particles. The pyrolysis process was carried out at 2 bar absolute pressure at an average pyrolysis temperature of 800° C. with a gas residence time of 5 seconds. Char was separated from the pyrolysate products through multiple cyclone separators at pyrolysis condition. The pyrolysate gaseous products were passed through multiple condensers. The gaseous product was analyzed by on-line Gas Chromatography. The gaseous pyrolysate contained substantial amounts of ethylene and propylene besides syngas and minor quantity of other light hydrocarbons. The liquid pyrolysate product was separated from aqueous layers and analyzed for the yield of benzene, toluene, xylene and other aromatics. The char obtained from the pyrolysis was analyzed for proximate analysis, which was in good agreement with the char used in gasifier with 1.2% volatile content.

Example 2

A bituminous coal (having similar characteristics as listed in TABLE 1) was fed to 60 mm ID (internal diameter) and 6 meter tall IN 519 reformer grade steel pyrolyzer connected to a separate gasifier. 5.75 kg/hr char containing 5 kg/h carbon was burnt with 4.2 kg/hr oxygen and 5 kg/hr steam in the gasifier. Hot syngas was generated at 1600° C. and 2 bar pressure in the gasifier, the syngas predominantly contained CO and $H_2$. The pyrolyzer feeding condition was maintained at 60 kg/hr at 2 bar pressure and 900° C. temperature. The average pyrolyzer temperature was maintained at 940° C. during pyrolysis and cracking with a residence time of 3.5 seconds. The pyrolysate product gases were passed through condensers and separated. The liquid and gaseous products were analyzed by gas chromatography after pre-treatment including cleaning and cooling. The liquid and gaseous products showed significant quantities of CO, $H_2$, $CO_2$, olefins (ethylene & propylene), benzene, toluene, xylene, and small quantities of methane, propane, ethane etc. The char was separated in cyclone separator and cooled and analyzed. The analysis showed that the char contained only 1% volatile matter.

Example 3

A bituminous coal (having similar characteristics as listed in TABLE 1) was pyrolyzed at 10 bar pressure in reformer steel reactor. Hot syngas was generated in a gasifier by burning char with pre-heated $O_2$ and steam at 600° C. The hot syngas contained CO—52%, $H_2$—21%, $CO_2$—9.6% and $H_2O$—16% (by mole). Pre-heated coal was flashed in the hot zone of the pyrolyzer with the syngas at 1600° C. Pyrolysis was carried out at an average pyrolysis temperature of 850° C. with a residence time of 3 seconds. Char was separated from the pyrolysate by passing through multiple cyclone separators and the gaseous petrochemical product were cooled in a series of condensers. The liquid petrochemical products were collected, purified and analyzed for benzene, toluene, xylene and other aromatic hydrocarbons. The liquid petrochemical product yield was found to be 15% of the total coal feed to the reactor whereas the char yield was found to be 52%. The gaseous product was analyzed by on-line gas chromatography for olefins, CO, $CO_2$ and other light hydrocarbons. The char was cooled in an inert atmosphere and analyzed for the volatile content. The char contained 1.4% volatiles.

Example 4

A bituminous coal (having similar characteristics as listed in TABLE 1) was pyrolyzed at 20 bar pressure in reformer steel reactor. Hot syngas was generated in a gasifier by burning char with pre-heated $O_2$ and steam at 600° C. The hot syngas contained CO—45% and $H_2$—21% along with $CO_2$, $CH_4$, and $H_2O$. Pre-heated coal was flashed in the hot zone of the pyrolyzer with the syngas at 1600° C. Pyrolysis was carried out at an average pyrolysis temperature of 800° C. with a residence time of 2 seconds. Char was separated from the pyrolysate by passing through multiple cyclone separators and the gaseous petrochemical product were cooled in a series of condensers. The liquid petrochemical products were collected, purified and analyzed for benzene, toluene, xylene and other aromatic hydrocarbons. The liquid petrochemical product yield was found to be 18% of the total coal feed to the reactor whereas the char yield was found to be 49%. The gaseous petrochemical product was analyzed by on-line gas chromatography for olefins, CO, $CO_2$ and other light hydrocarbons. The char was cooled in an inert atmosphere and analyzed. The char contained 2% volatiles.

Technical Advantages

A process for obtaining petrochemical products from carbonaceous feedstock; as described in the present invention has several technical advantages including but not limited to the realization of:

the process of present invention is highly efficient, simple, and easy-to-operate;

the process of the present invention provides uniform heat distribution in the carbonaceous feed during pyrolysis;

the process of the present invention is single-stage and does not require very high operating pressures; and in the process of the present invention the pyrolysate can be conveniently processed to obtain numerous valuable products.

The numerical values mentioned for the various physical parameters, dimensions or quantities are only approximations and it is envisaged that the values higher/lower than the numerical values assigned to the parameters, dimensions or quantities fall within the scope of the invention, unless there is a statement in the specification specific to the contrary. Wherever a range of values is specified, a value up to 10% below and above the lowest and highest numerical value respectively, of the specified range, is included in the scope of the invention.

In view of the wide variety of embodiments to which the principles of the present invention can be applied, it should be understood that the illustrated embodiments are exemplary only. While considerable emphasis has been placed herein on the particular features of this invention, it will be appreciated that various modifications can be made, and that many changes can be made in the preferred embodiments without departing from the principle of the invention. These and other modifications in the nature of the invention or the preferred embodiments will be apparent to those skilled in the art from the disclosure herein, whereby it is to be distinctly understood that the foregoing descriptive matter is to be interpreted merely as illustrative of the invention and not as a limitation.

The invention claimed is:

1. A process for obtaining petrochemical products from a carbonaceous feedstock, said process comprising:

pulverising a carbonaceous feedstock to obtain a pulverized feedstock having mesh size between 50-300; pyrolyzing the pulverized feedstock with syngas in a pyrolysis reactor at a temperature in the range of 700-1000° C. and a pressure in the range of 2-25 bar for 2-10 seconds to obtain pyrolysate comprising char, fluid petrochemical product, and at least a portion of the syngas; and gasifying the char with oxygen and steam at a temperature between 1200-1700° C. and pressure higher than the pyrolyzing pressure to obtain syngas having hydrogen content between 20-30 mole %.

2. The process as claimed in claim 1, which includes the step of selecting the carbonaceous feedstock from at least one material consisting of coal, lignite, biomass, coke, bitumen, or organic waste.

3. The process as claimed in claim 1, which includes the step of treating the pyrolsate to separate char, fluid petrochemical product, and syngas.

4. The process as claimed in claim 1, which includes the step of cracking the fluid petrochemical product to obtain at least one hydrocarbon from ethylene, propylene, benzene, toluene, xylene, methane, and ethane.

5. The process as claimed in claim 1, which includes the step of entraining the pulverized feedstock in the syngas during pyrolyzing.

6. The process as claimed in claim 1, wherein the pyrolysis reactor is a brick-lined vertical reactor.

7. The process as claimed in claim 4, which includes the step of using a cracking catalyst obtained by mixing dry coal powder with at least one compound from fine red mud and alumina containing molybdenum oxide.

8. The process as claimed in claim 1, wherein mesh size of the pulverized feedstock ranges between 100-200.

* * * * *